US011134322B2

(12) United States Patent
Minoda

(10) Patent No.: US 11,134,322 B2
(45) Date of Patent: Sep. 28, 2021

(54) WEARABLE SPEAKER SYSTEM

(71) Applicant: SHARP KABUSHIKI KAISHA, Sakai (JP)

(72) Inventor: Hidenori Minoda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 100 days.

(21) Appl. No.: 16/492,039

(22) PCT Filed: Jan. 29, 2018

(86) PCT No.: PCT/JP2018/002700
§ 371 (c)(1),
(2) Date: Nov. 22, 2019

(87) PCT Pub. No.: WO2018/163653
PCT Pub. Date: Sep. 13, 2018

(65) Prior Publication Data

US 2021/0136470 A1 May 6, 2021

(30) Foreign Application Priority Data

Mar. 8, 2017 (JP) ..... JP2017-043602

(51) Int. Cl.
*H04R 1/02* (2006.01)
*H04R 1/28* (2006.01)

(52) U.S. Cl.
CPC ..... *H04R 1/02* (2013.01); *H04R 1/28* (2013.01)

(58) Field of Classification Search
CPC ..... H04R 1/02; H04R 1/28
See application file for complete search history.

(56) References Cited

U.S. PATENT DOCUMENTS

| | | | | |
|---|---|---|---|---|
| 8,761,431 | B1 * | 6/2014 | Jackson | H04R 5/0335 381/385 |
| 2014/0126760 | A1 * | 5/2014 | Tse | H04R 5/02 381/334 |
| 2016/0021446 | A1 | 1/2016 | Litovsky et al. | |

FOREIGN PATENT DOCUMENTS

| | | | |
|---|---|---|---|
| CN | 102196330 | A | 9/2011 |
| CN | 104168526 | A | 11/2014 |
| JP | H08-511151 | A | 11/1996 |
| JP | 2008-263374 | A | 10/2008 |
| JP | 2009-201088 | A | 9/2009 |
| TW | 201605250 | A | 2/2016 |
| WO | 95/34184 | A1 | 12/1995 |
| WO | 2016/039245 | A1 | 3/2016 |

* cited by examiner

*Primary Examiner* — Andrew L Sniezek
(74) *Attorney, Agent, or Firm* — ScienBiziP, P.C.

(57) ABSTRACT

Provided is a wearable speaker system that can obtain a higher sense of presence through reproduction of bass. A wearable speaker system includes an enclosure, in which a first speaker unit and a first opening portion that is an end of a first bass reflex duct are disposed in a first end region of the enclosure, in which a second speaker unit and a second opening portion that is an end of a second bass reflex duct are disposed in a second end region, in which each of the first and second speaker units and includes a speaker and a passive radiator that faces in an opposite direction from the speaker, and in which a space between the speaker and the passive radiator included in each of the first and second speaker units and is connected to a space in the enclosure.

12 Claims, 5 Drawing Sheets

WEARABLE SPEAKER SYSTEM

TECHNICAL FIELD

The present invention relates to a wearable speaker system, and more particularly to a wearable speaker system that is used by a listener worn on a portion other than the ears.

BACKGROUND ART

As a speaker system that outputs sound, for example, there is one built in a television receiver or the like. However, a speaker of the built-in speaker system does not have a large caliber and cannot obtain a large volume, and bass cannot be reproduced sufficiently, which may result in lack of a sense of presence. In order to obtain the sense of presence, a speaker system having a large caliber speaker and headphones are often used.

In a case in which a speaker system having a large caliber speaker is used, a certain amount of space is required, which is not suitable for enjoying music or the like while moving. When the headphones are used, music or the like can be enjoyed while moving, but there is a problem that a listener using the headphones cannot hear surrounding sound. In the case of the headphones, a sound image is localized in the head of the listener, so that there is a problem of feeling tired when the headphones are used for a long time.

In order to solve the above problems, PTLs 1 to 4 each disclose a wearable speaker system that is worn on the body of a listener and does not block the ear of the listener.

PTL 1 discloses a neck-hanging type wearable speaker device, in which a speaker is positioned under the chin of the listener and faces the ear. PTLs 2 and 3 each disclose a wearable speaker device in which speakers are provided on both sides of a neck hanging portion, a right ear speaker is positioned on a right shoulder, and a left ear speaker is positioned on a left shoulder.

PTL 4 discloses an annular neck-hanging type wearable speaker device, which includes a passive radiator or a bass reflex port in addition to the speaker, and, unlike the wearable speaker devices in PTLs 1 to 3, is capable of reproducing bass and can give the listener the sense of presence.

CITATION LIST

Patent Literature

PTL 1: Japanese Unexamined Patent Application Publication No. 2009-201088

PTL 2: Japanese Unexamined Patent Application Publication No. 2008-263374

PTL 3: Japanese Unexamined Patent Application Publication (Translation of PCT Application) No. 8-511151

PTL 4: International Publication No. 2016/039245

SUMMARY OF INVENTION

Technical Problem

As described above, each wearable speaker system described in PTLs 1 to 3 does not include a mechanism related to reproduction of bass. Further, in the wearable speaker device disclosed in PTL 4, the speaker, the passive radiator, and the bass reflex port are separated from each other, so that the reproduction of the bass may not be sufficiently performed and the sense of presence may be insufficient.

The present invention has been made in view of the above circumstances, and an object of the present invention is to provide a wearable speaker system that can provide a higher sense of presence through reproduction of bass.

Solution to Problem

In order to solve the problem, a wearable speaker system according to first technical means of the present invention includes: a U-shaped enclosure, in which a first speaker unit and an end of a first bass reflex duct are disposed in a first end region of the enclosure, in which a second speaker unit and an end of a second bass reflex duct are disposed in a second end region of the enclosure, in which each of the first and second speaker units includes a speaker and a passive radiator that faces in an opposite direction from the speaker, and in which a space between the speaker and the passive radiator included in each of the first and second speaker units is connected to a space in the enclosure.

According to second technical means of the present invention, in the first technical means of the present invention, main body portions of the first and second bass reflex ducts intersect each other at a center portion of the enclosure.

According to third technical means of the present invention, in the first or second technical means of the present invention, the first end region and the second end region of the enclosure communicate with each other.

According to fourth technical means of the present invention, in the first or second technical means of the present invention, the enclosure includes a partition that separates the first end region and the second end region of the enclosure into a plurality of spaces.

According to fifth technical means of the present invention, in any one of the first to fourth technical means of the present invention, when the enclosure is hung on a neck of a listener, each of the end of the first bass reflex duct and the end of the second bass reflex duct is positioned below an ear of the listener.

According to sixth technical means of the present invention, in any one of the first to fifth technical means of the present invention, when the enclosure is hung on a neck of a listener, the speaker units are positioned on an upper chest of the listener.

According to seventh technical means of the present invention, in any one of the first to sixth technical means of the present invention, the wearable speaker system further includes a first cushioning member inside the U-shaped enclosure.

According to eighth technical means of the present invention, in any one of the fifth to seventh technical means of the present invention, the wearable speaker system further includes a second cushioning member between the first end region and the second end region of the enclosure, and the listener.

Advantageous Effects of Invention

According to the present invention, it is possible to provide a wearable speaker system that can obtain a higher sense of presence through reproduction of bass.

DESCRIPTION OF EMBODIMENTS

Figure 1:
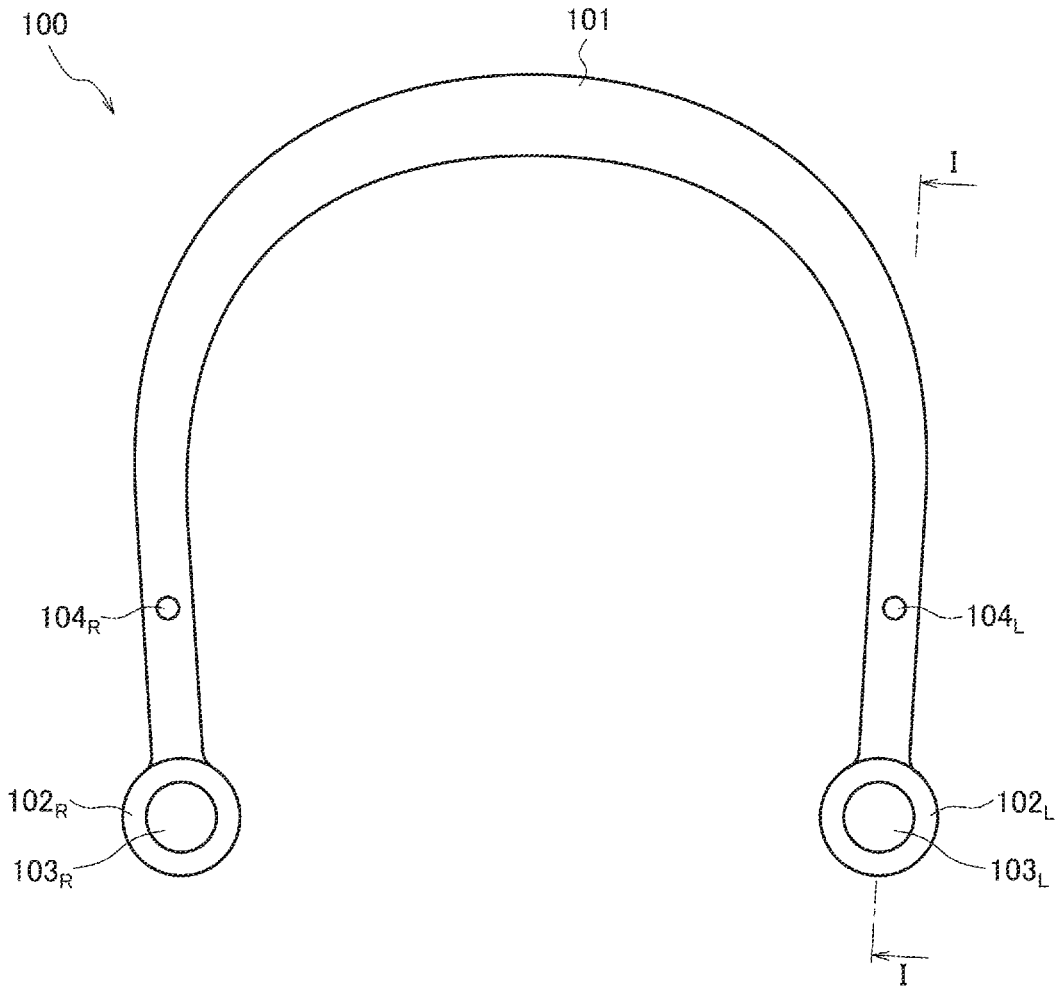
FIG. 1 is a front view of a wearable speaker system according to Embodiment 1 of the present invention.

Hereinafter, preferred embodiments of a wearable speaker system of the present invention will be described with reference to the drawings. In the following description, the same reference numerals are assumed to be the same configurations and the description thereof may be omitted. Moreover, although a plurality of embodiments are described, as long as a combination is possible, an embodiment can be implemented in arbitrary combinations.

Embodiment 1

FIG. 1 is a front view of a wearable speaker system 100 according to Embodiment 1. The wearable speaker system 100 includes an enclosure 101. The enclosure 101 is substantially U-shaped when viewed from the front. A shape of the enclosure 101 when viewed from the front can also be expressed as a horseshoe shape, a reversed U-shape, or the like. The enclosure 101 includes portions extending from a center portion in both directions of a left diagonally downward direction and a right diagonally downward direction in FIG. 1, and portions extending downward in FIG. 1 from the portions toward both tips of the enclosure 101.

As one of usage states of the wearable speaker system 100, as will be described later with reference to FIG. 3, it is in a "state of being hung on the neck" in which a center portion of the enclosure 101 is positioned behind the neck of a listener, and other portions of the enclosure 101 are positioned diagonally left and right forward from the back of the neck of the listener through both sides of the neck. Hereinafter, a left-right direction and a left-right relationship regarding the wearable speaker system 100 will be respectively described as a left-right direction and a left-right relationship for a listener in a state in which the wearable speaker system 100 is hung on the neck (this is consistent with the fact that the "left ear" and the "right ear" of the listener are determined by the left and right for the listener). Therefore, in the following description, the left-right direction and the left-right relationship with respect to the drawing may be an opposite direction and opposite relationship to each other.

A portion of the enclosure 101 having a prescribed length from a left tip of both tips thereof is referred to as a first end region (left end region), and a portion of the enclosure 101 having a prescribed length from a right tip of the both tips is referred to as a second end region (right end region). In the enclosure 101, a first speaker unit 1021, and a first opening portion $\mathbf{104}_L$ that is an end of a first bass reflex duct are disposed in this order frot the left tip, and a second speaker unit $\mathbf{102}_R$ and a second opening portion $\mathbf{104}_R$ that is an end of a second bass reflex duct are disposed in this order from the right tip. A length (the "prescribed length from the left tip of the both tips of the enclosure 101") of the first end region (left end region) of the enclosure 101 is defined as a length sufficient to include the first speaker unit $\mathbf{102}_L$ and the first opening portion $\mathbf{104}_L$. A length (the "prescribed length from the right tip of the both tips of the enclosure 101") of the second end region (right end region) of the enclosure 101 is defined as a length sufficient to include the second speaker unit $\mathbf{102}_R$ and the second opening portion $\mathbf{104}_R$.

Figure 2:
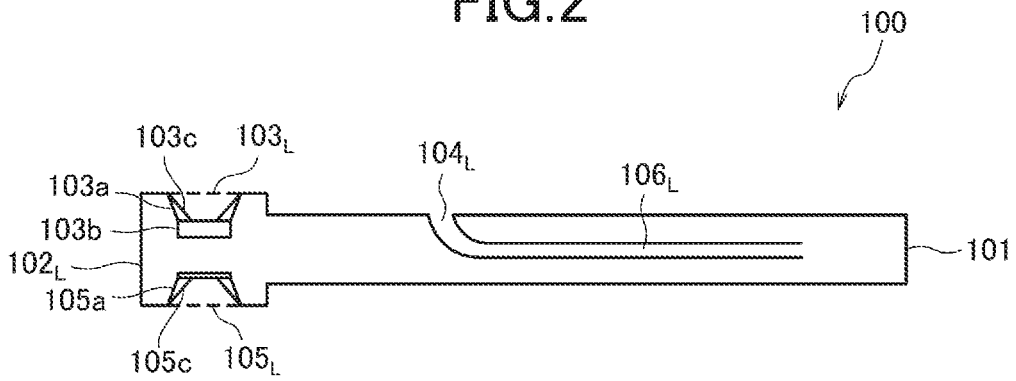
FIG. 2 is a sectional view of the wearable speaker system according to Embodiment 1 of the present invention.

FIG. 2 is a sectional view in a middle from the tip of the first end region (left end region) of the enclosure 101 to the center portion, taken along sectional line I-I in FIG. 1. FIG. 2 illustrates a cross section of a part of the enclosure 101, a cross section of the first speaker unit $\mathbf{102}_L$, and a cross section of the first opening portion $\mathbf{104}_L$. In addition, since the sectional view in the middle from the tip of the second end region (right end region) of the enclosure 101 to the center portion can also be obtained by reversing the left and right in the illustration of FIG. 2, the illustration will be omitted.

The first speaker unit $\mathbf{102}_L$ includes a speaker $\mathbf{103}_L$ having an opening upward in FIG. 2 and a passive radiator $\mathbf{105}_L$ having an opening downward in FIG. 2. In other words, the passive radiator $\mathbf{105}_L$ is provided on a back surface of the speaker $\mathbf{103}_L$. Further, the first speaker unit $\mathbf{102}_L$ includes the speaker $\mathbf{103}_L$ and the passive radiator $\mathbf{105}_L$ that faces in the opposite direction from the speaker $\mathbf{103}_L$. The speaker $\mathbf{103}_L$ includes a frame 103*a* forming the speaker $\mathbf{103}_L$, a magnetic circuit 103*b* supported by the frame 103*a*, and a diaphragm 103*c* connected to the magnetic circuit 103*b* and the frame 103*a*. The magnetic circuit 103*b* includes a magnet and a voice coil (not illustrated). The voice coil is connected to a cable (not illustrated), and vibrates the diaphragm 103*c* according to a signal supplied to the cable to generate sound.

The passive radiator $\mathbf{105}_L$ includes a frame 105*a* that forms the passive radiator $\mathbf{105}_L$ and a diaphragm 105*c* that is connected to the frame 105*a*. The passive radiator $\mathbf{105}_L$ generates sound by vibrating the diaphragm 105*c* in accordance with a change in the atmospheric pressure in the first speaker unit $\mathbf{102}_L$ due to the vibration of the diaphragm 103*c* of the speaker $\mathbf{103}_L$. As described above, the diaphragm 105*c* of the passive radiator $\mathbf{105}_L$ vibrates in accordance with the change in the atmospheric pressure, and does not directly vibrate by the magnetic circuit. Therefore, the passive radiator $\mathbf{105}_L$ mainly radiates bass having a low frequency of the change in the atmospheric pressure, in the sound generated by the speaker $\mathbf{103}_L$, out of the first speaker unit $\mathbf{102}_L$.

Therefore, even if the speaker $\mathbf{103}_L$ has a small caliber, the bass is emphasized and reproduced by the passive radiator $\mathbf{105}_L$ disposed facing in the opposite direction from the back surface of the speaker $\mathbf{103}_L$, and the listener can obtain a high sense of presence.

In the present embodiment, a space in the enclosure 101 is connected to a space between the speaker $\mathbf{103}_L$ and the passive radiator $\mathbf{105}_L$. In addition, a hollow space (internal space) that communicates the first end region (left end region) and the second end region (right end region) with each other is formed in the enclosure 101. Therefore, the change in the atmospheric pressure in the first speaker unit $\mathbf{102}_L$ due to the vibration of the diaphragm 103*c* of the speaker $\mathbf{103}_L$ is also transmitted to the internal space of the enclosure 101. Therefore, the enclosure 101 also vibrates according to the vibration of the diaphragm 103*c* of the speaker $\mathbf{103}_L$, and can generate a certain amount of sound.

Similarly, the change in the atmospheric pressure in the second speaker unit $\mathbf{102}_R$ due to the vibration of the diaphragm 103*c* of the speaker $\mathbf{103}_R$ is also transmitted to the internal space of the enclosure 101. Therefore, the enclosure 101 also vibrates according to the vibration of the diaphragm 103*c* of the speaker $\mathbf{103}_R$, and can generate a certain amount of sound.

In addition, since the space in the enclosure 101 communicates with the first end region (left end region) and the second end region (right end region), the change in the atmospheric pressure due to the vibration of the diaphragm 103*c* of the speaker $\mathbf{103}_L$ of the first speaker unit $\mathbf{102}_L$ can reach the second speaker unit $\mathbf{102}_R$. Therefore, the change in the atmospheric pressure due to the vibration of the diaphragm 103*c* of the speaker $\mathbf{103}_L$ affects the vibration of the diaphragm of the passive radiator (not illustrated) of the second speaker unit $\mathbf{102}_R$. Similarly, the change in the atmospheric pressure due to the vibration of the diaphragm of the speaker $\mathbf{103}_R$ of the second speaker unit $\mathbf{102}_R$ reaches the first speaker unit $\mathbf{102}_L$, and affects the vibration of the diaphragm 103*c* of the passive radiator $\mathbf{105}_L$ of the first speaker unit $\mathbf{102}_L$. Therefore, when comparing between a case of the headphones that block both ears of the related art and a case of the wearable speaker system 100, even if the sound is audible only to the left ear in the case of the headphones or the related art, in the case of the wearable speaker system 100, some components are also generated from the passive radiator of the second speaker unit $\mathbf{102}_R$. In addition, even when the sound is audible only to the right ear in the case of the headphones of the related art, in the case of the wearable speaker system 100, some components are also generated from the passive radiator $\mathbf{105}_L$ of the first speaker unit $\mathbf{102}_L$. Therefore, since the left and right sounds are mixed and reproduced from the left and right speakers and heard even if the left and right sounds are not equal, the listener can feel that a localization position of a sound image is positioned in front of the head of the listener, and the sense of presence can be enhanced.

A cable for driving the speaker $\mathbf{103}_L$ may be disposed in the internal space in the enclosure 101. In addition, a driving circuit and a driving power source for supplying a signal to the cable and driving the speaker $\mathbf{103}_L$ may be disposed in the internal space.

Further, as described above, the first opening portion $\mathbf{104}_L$ is an end of the first bass reflex duct $\mathbf{106}_L$. The other end of the first bass reflex duct $\mathbf{106}_L$ extends from the first speaker unit $\mathbf{102}_L$ toward the space in the enclosure 101. Therefore, when the atmospheric pressure inside the enclosure 101 changes according to the vibration of the diaphragm 103*c* of the speaker $\mathbf{103}_L$, entering and exiting of air from the first opening portion $\mathbf{104}_L$ via the other end of the first bass reflex duct $\mathbf{106}_L$ are generated. The listener can feel bass by the entering and exiting of the air.

In FIG. 2, a height of the first speaker unit $\mathbf{102}_L$ and a height of the enclosure 101 are illustrated different from each other, but at the same height, the sense of unity between the first speaker unit $\mathbf{102}_L$ and the enclosure 101 can be further increased, and a decorative effect that makes the wearer of the wearable speaker system 100 look aesthetic can be obtained. In FIG. 1, widths of the first speaker unit $\mathbf{102}_L$ and the second speaker unit $\mathbf{102}_R$ in a lateral direction are different from a width of the enclosure 101, but it is also possible to make the widths of the first speaker unit $\mathbf{102}_L$ and the second speaker unit $\mathbf{102}_R$ in a lateral direction the same as the width of the enclosure 101.

Figure 3:
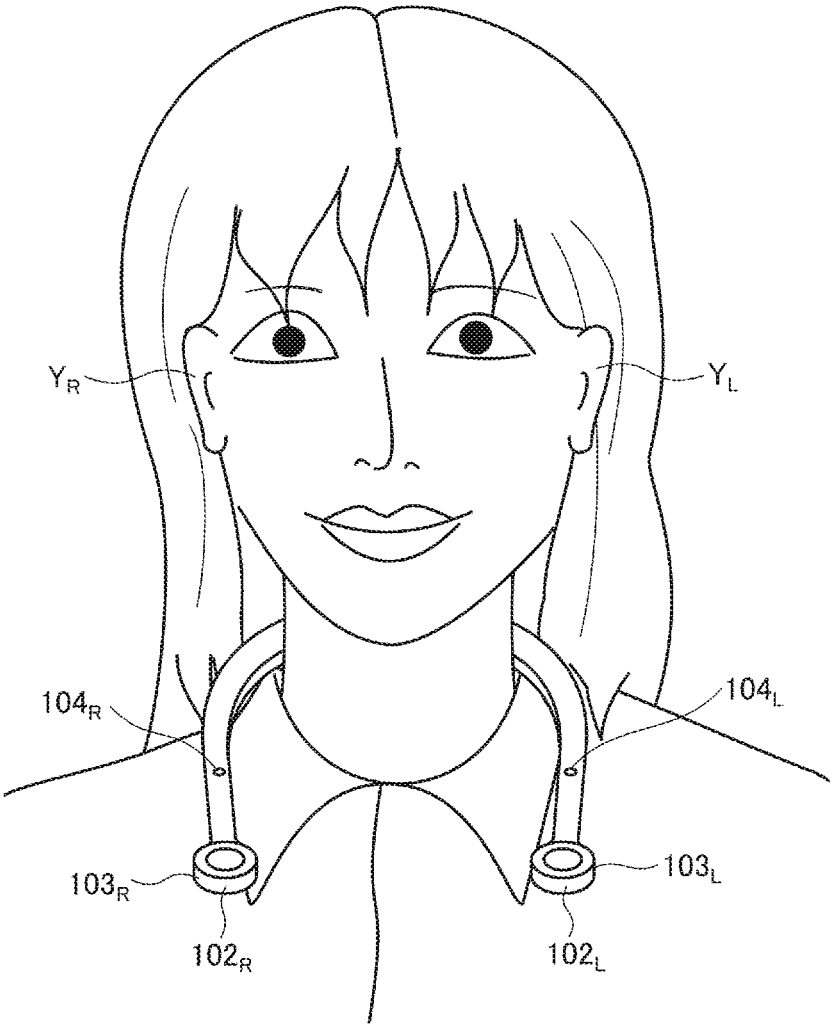
FIG. 3 is a view for explaining the wearable speaker system according to Embodiment 1 of the present invention.

FIG. 3 illustrates a state (state of being hung on the neck) in which the wearable speaker system 100 is hung on the neck of the listener, the first end region and the second end region of the enclosure 101 are positioned in front of the neck, and the center portion of the enclosure 101 is positioned in the back of the neck. As illustrated in FIG. 3, in a case in which the wearable speaker system 100 is hung on the neck of the listener, the first speaker units $\mathbf{102}_L$ and $\mathbf{102}_R$ are preferably positioned in a portion of an upper chest portion of the listener. For example, the first speaker unit $\mathbf{102}_L$ and the second speaker unit $\mathbf{102}_R$ are preferably positioned on the clavicle or an upper portion of the breast. Therefore, in a case in which the wearable speaker system 100 is hung with openings of the speakers $\mathbf{103}_L$ and $\mathbf{103}_R$ facing upward, the listener can feel the vibration of the bass emitted from the passive radiators $\mathbf{105}_L$ and $\mathbf{105}_R$ with his/her body. Further, since a part of the enclosure 101 is also in contact with the back of the neck and the upper chest of the listener, the vibration of the enclosure 101 due to the vibration of the diaphragm 103*c* of each of the speakers $\mathbf{103}_L$ and $\mathbf{103}_R$, and the sound generated by the vibration can be felt by the body. Since the enclosure 101 is disposed so as to surround the neck of the listener, the listener can feel that the vibration of the enclosure 101 and the sound generated by the vibration are emitted from surroundings of the body, and it is possible to obtain a higher sense of presence.

As illustrated in FIG. 3, in a case in which the wearable speaker system 100 is hung on the neck of the listener, it is preferable that the first opening portion $\mathbf{104}_L$ and the second opening portion $\mathbf{104}_R$ are respectively positioned below ears $Y_L$ and $Y_R$ of the listener. Therefore, the listener can listen the bass generated by the entering and exiting of air from the first opening portion $\mathbf{104}_L$ via the main body portion from the other end of the first bass reflex duct $\mathbf{106}_L$ due to the vibration of the diaphragm 103*c* of the speaker $\mathbf{103}_L$. In addition, the listener can hear the bass generated by the entering and exiting of air from the second opening portion $\mathbf{104}_R$ via the main body portion from the other end of the second bass reflex duct due to the vibration of the diaphragm 103*c* of the speaker $\mathbf{103}_R$. Therefore, it is possible to obtain a higher sense of presence.

As described above, according to the present embodiment, the bass can be reproduced, and the listener can obtain a higher sense of presence by the speaker $\mathbf{103}_L$ and the passive radiator $\mathbf{105}_L$, the speaker $\mathbf{103}_R$ and the passive radiator $\mathbf{105}_R$, and the first bass reflex duct $\mathbf{106}_L$ and the second bass reflex duct $\mathbf{106}_R$.

Further, even in a state in which the wearable speaker system 100 is hung on the neck, unlike the headphones, the ears of the listener are not blocked. Therefore, since the sound image is not localized in the head of the listener, there is little feeling of fatigue. In addition, since the ears of listener are not blocked, the listener can hear surrounding sounds, so that attention can be paid to the surroundings in order to avoid dangers. Moreover, since the wearable speaker system 100 is in a state of being hung on the neck, the wearable speaker system 100 is worn at a position close to the ears. Therefore, a sound field does not change even when the listener moves, and a sufficient sound pressure can be obtained even at a low volume.

A use scene of the wearable speaker system 100 of the present embodiment as described above includes a scene of listening to music or the like in combination with a music playback device, a smartphone, or a tablet-type terminal, or watching, with sound, a video displayed on a screen of the smartphone or the tablet terminal. In addition, by the wearable speaker system 100, it is also possible to reproduce TV sound that is difficult to hear due to a decline in hearing ability in the ears of elderly people or the like. In addition, it is possible to obtain a high sense of presence through vision and hearing by being combined with a virtual reality or augmented reality system.

Embodiment 2

Figure 4:
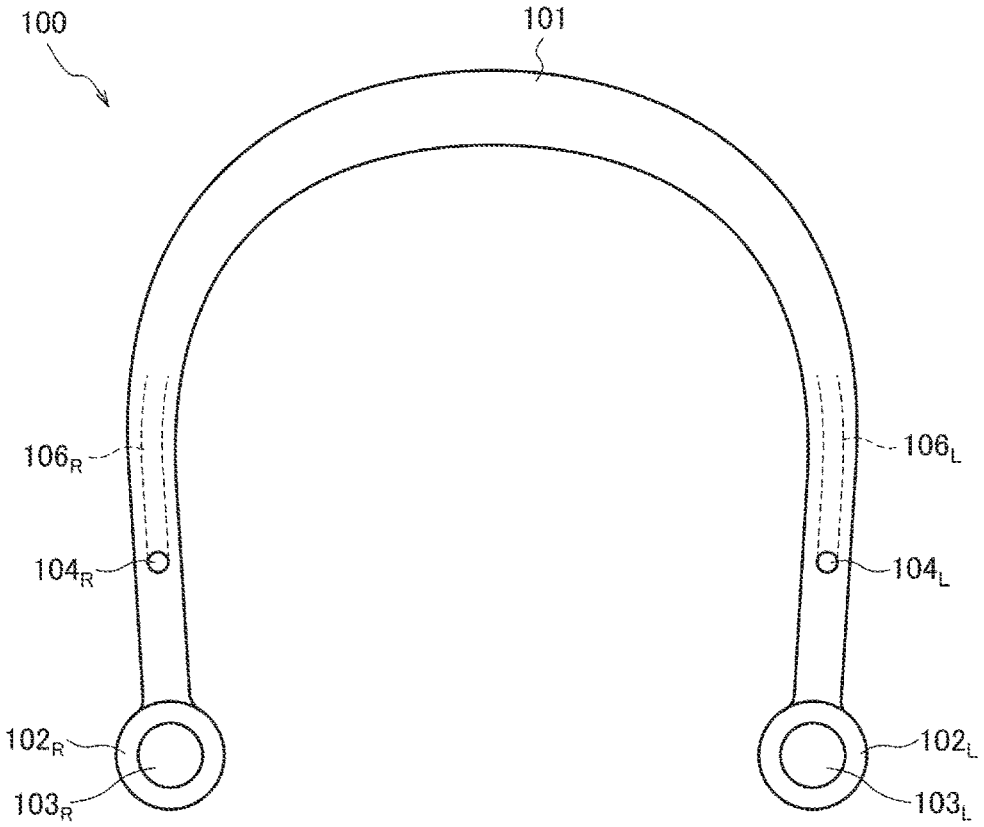
FIG. 4 is a front perspective view of a wearable speaker system according to Embodiment 2 of the present invention.
Figure 5:
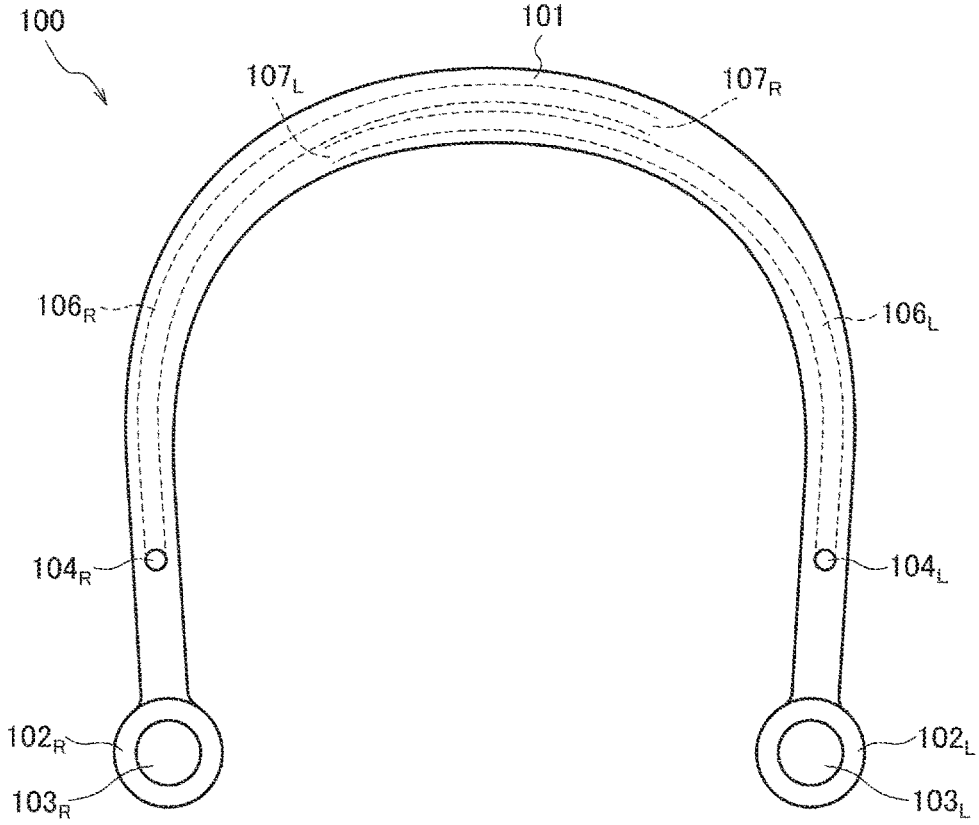
FIG. 5 is a front perspective view of the wearable speaker system according to Embodiment 2 of the present invention.

FIGS. 4 and 5 are front perspective views of a wearable speaker system 100 according to Embodiment 2 of the present invention as respectively viewed from the front.

FIG. 4 is a view illustrating main body portions of a first bass reflex duct $\mathbf{106}_L$ and a second bass reflex duct $\mathbf{106}_R$ by dotted lines. Lengths of main body portions of the first bass reflex duct $\mathbf{106}_L$ and the second bass reflex duct $\mathbf{106}_R$ can be arbitrarily selected according to which range in a low frequency region of the sound emitted from speakers $\mathbf{103}_L$ and $\mathbf{103}_R$ is to be emphasized. In general, when the lengths of the main body portions of the first bass reflex duct $\mathbf{106}_L$ and the second bass reflex duct $\mathbf{106}_R$ are made longer, the lower frequency range is emphasized.

In addition, the first bass reflex duct $\mathbf{106}_L$ and the second bass reflex duct $\mathbf{106}_R$ may be related to a sound localization position as described below. For example, as illustrated in FIG. 5, the lengths of the main body portions of the first bass reflex duct $\mathbf{106}_L$ and the second bass reflex duct $\mathbf{106}_R$ are further increased, and other ends $\mathbf{107}_L$ and $\mathbf{107}_R$ may be positioned exceeding a center portion of an enclosure 101. In other words, the main body portions of the first bass reflex duct $\mathbf{106}_L$ and the second bass reflex duct $\mathbf{106}_R$ may intersect each other in a region including a center portion of the enclosure 101.

According to such a configuration of the first bass reflex duct $\mathbf{106}_L$ and the second bass reflex duct $\mathbf{106}_R$, the first bass reflex duct $\mathbf{106}_L$ causes a change in the atmospheric pressure corresponding to the sound generated by the second speaker unit $\mathbf{102}_R$ to be guided to the first opening portion $\mathbf{104}_L$, and the second bass reflex duct $\mathbf{106}_R$ causes the change in the atmospheric pressure corresponding to the sound generated by the first speaker unit $\mathbf{102}_L$ to be guided to the second opening portion $\mathbf{104}_R$. Therefore, entering and exiting of the air, corresponding to the sound generated by the second speaker unit $\mathbf{102}_R$, are generated from the first opening portion $\mathbf{104}_L$, and entering and exiting of the air, corresponding to the sound generated by the first speaker unit $\mathbf{102}_L$, are generated from the second opening portion $\mathbf{104}_R$.

Therefore, since the listener hears the sound in a state in which the sound heard on the right ear is mixed with the sound heard on the left ear, and the sound heard on the left ear is mixed with the sound on the right ear, the sound is heard. Therefore, the sound is heard as the sound localization position is moved forward, and it is possible to obtain a higher sense of presence than that in the configuration illustrated in FIG. 4.

Embodiment 3

Figure 6:
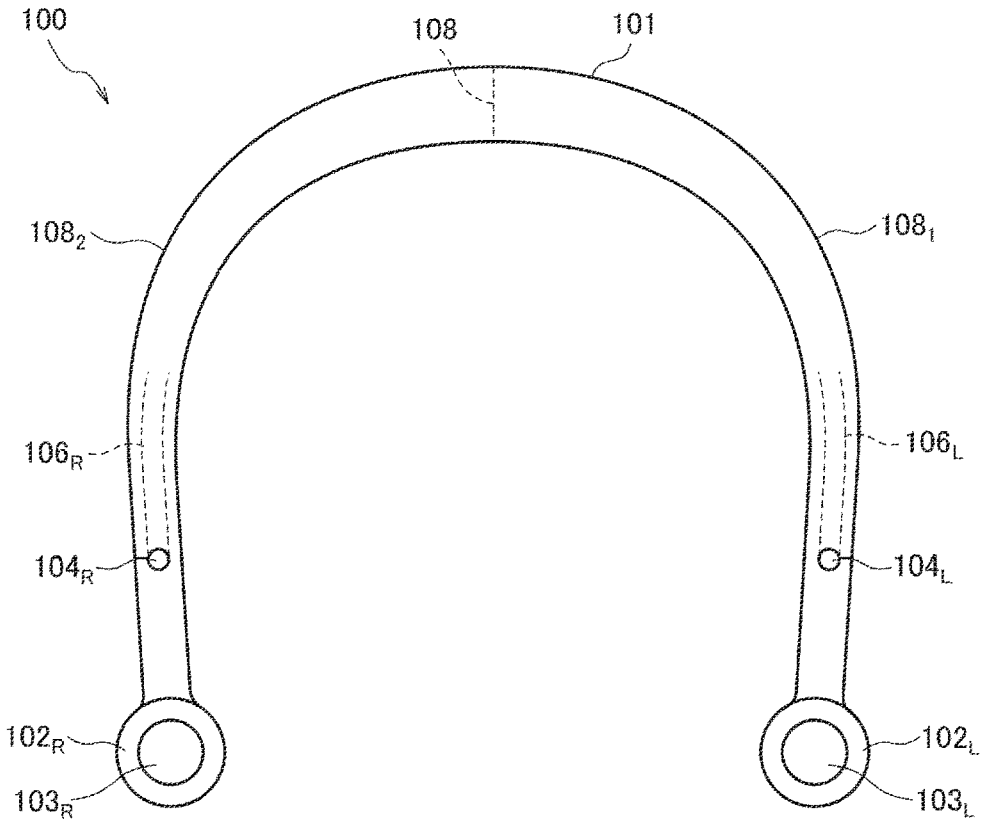
FIG. 6 is a front perspective view of a wearable speaker system according to Embodiment 3 of the present invention.
Figure 7:
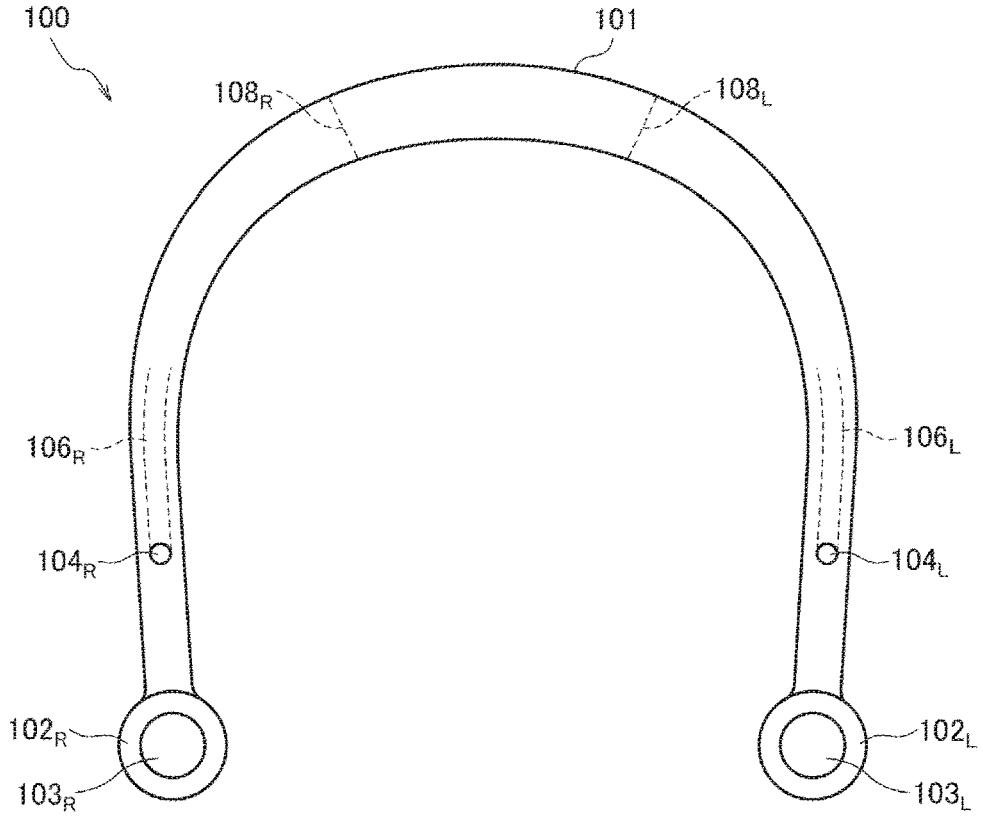
FIG. 7 is a front perspective view of the wearable speaker system according to Embodiment 3 of the present invention.

FIGS. 6 and 7 are front perspective views of a wearable speaker system 100 according to Embodiment 3 of the present invention, as viewed from the front.

In FIGS. 6 and 7, portions disposed inside an enclosure 101 are indicated by dotted lines. For example, in FIG. 6, main body portions of a first bass reflex duct $\mathbf{106}_L$ and a second bass reflex duct $\mathbf{106}_R$ are indicated by dotted lines, and a partition 108 is indicated by a dotted line in a center portion of the enclosure 101.

The partition 108 is a member that partitions an internal space of the enclosure 101. Due to the partition 108, an internal space of the enclosure 101 is separated into two spaces of an internal space $\mathbf{108}_1$ on a first end region (left end region) side and an internal space $\mathbf{108}_2$ on a second end region (right end region) side. The internal space $\mathbf{108}_1$ is connected to a first opening portion $\mathbf{104}_L$ and a first speaker unit $\mathbf{102}_L$, and the internal space $\mathbf{108}_2$ is connected to a second opening portion $\mathbf{104}_R$ and a second speaker unit $\mathbf{102}_R$. Therefore, a change in the atmospheric pressure in the internal space $\mathbf{108}_1$ is not transmitted to the internal space $\mathbf{108}_2$, and a change in the atmospheric pressure in the internal space $\mathbf{108}_2$ is not transmitted to the internal space $\mathbf{108}_1$.

Therefore, a so-called sharp sound due to enhancement of left and right separation characteristics, by the partition 108, of the sound generated by the first speaker unit $\mathbf{102}_L$ and the second speaker unit $\mathbf{102}_R$ can be heard.

A plurality of partitions 108 can be disposed. Therefore, the internal space $\mathbf{108}_1$ and the internal space $\mathbf{108}_2$ can be adjusted to a length that is half or less of the enclosure 101.

FIG. 7 is a view illustrating a state in which two partitions $\mathbf{108}_L$ and $\mathbf{108}_R$ are disposed in the enclosure 101. Between the two partitions $\mathbf{108}_L$ and $\mathbf{108}_R$, a driving power source and a driving circuit for driving speakers $\mathbf{103}_L$ and $\mathbf{103}_R$, and an input unit of an external sound source can be disposed. For example, if a phone jack is provided in the enclosure 101 as an input unit of an external sound source, entering and exiting of the air can be generated via the phone jack, so that acoustic characteristics of the wearable speaker system 100 may change. However, it is possible to prevent a change in acoustic characteristics by providing a phone jack between the partitions $\mathbf{108}_L$ and $\mathbf{108}_R$.

Embodiment 4

Figure 8:
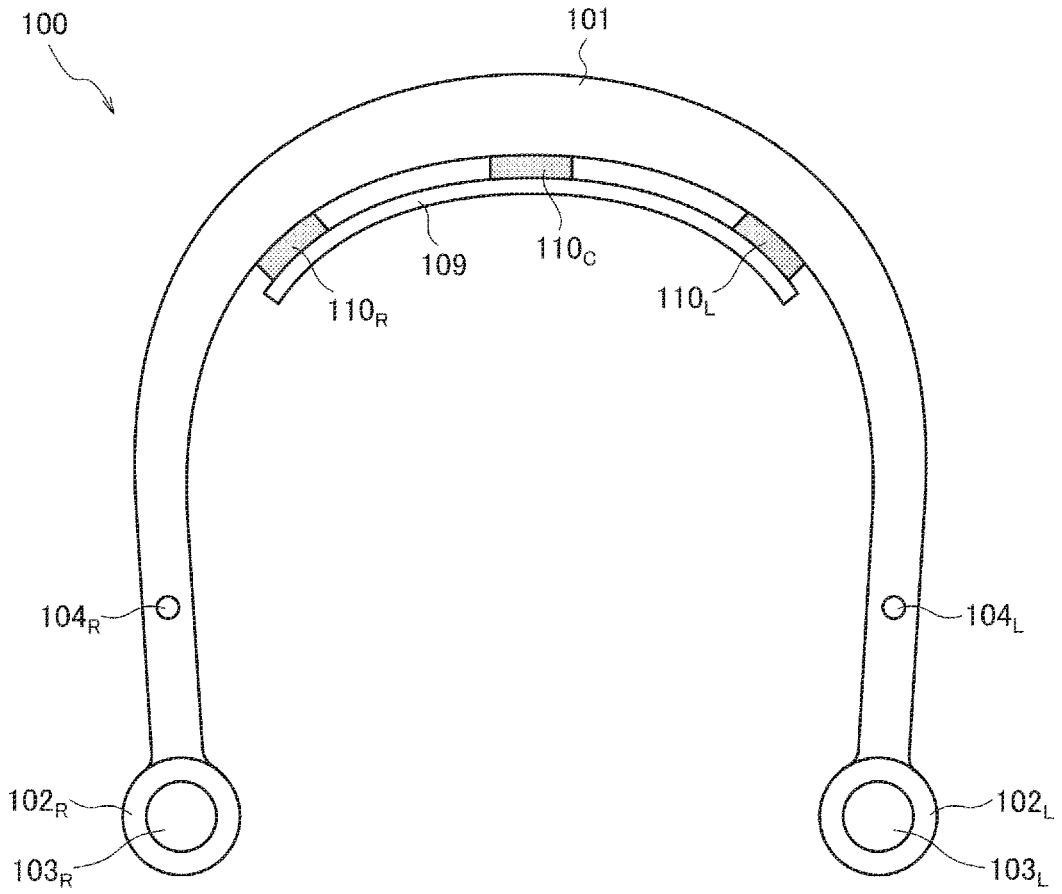
FIG. 8 is a front perspective view of a wearable speaker system according to Embodiment 4 of the present invention.

FIG. 8 is a front view of a wearable speaker system 100 according to Embodiment 4 of the present invention. A difference from the previous embodiments is that a neck cushioning member 109 is formed by cushioning materials $\mathbf{110}_L$, $\mathbf{110}_C$ and $\mathbf{110}_R$ inside a U-shape of the enclosure 101. The neck cushioning member 109 may be referred to as a first cushioning member.

As illustrated in FIG. 3, in a state in which the wearable speaker system 100 is hung on the neck, the neck cushioning member 109 reduces the vibration of the enclosure 101 generated by the vibration of respective diaphragms 103*c* of speakers 103L and 103R, and prevents the vibration of the enclosure 101 from being directly transmitted to the listener. When medium and high sounds are emitted from the first speaker unit $\mathbf{102}_L$, and the second speaker unit $\mathbf{102}_R$, and the vibration due to the medium and high sounds is transmitted to the back of the neck of the listener via the enclosure 101, the listener may feel uncomtbrtable. Therefore, by transmitting the vibration due to the medium and high sounds to the listener via the neck cushioning member 109, which is attenuated by the cushioning materials $\mathbf{110}_L$, $\mathbf{110}_C$, and $\mathbf{110}_R$, it is possible to remove the uncomfortable feeling of the listener due to the medium and high sounds. As a material of the cushioning material, for example, an expandable and contractible material such as rubber, polyurethane foam, or a spring can be used.

Embodiment 5

Figure 9:
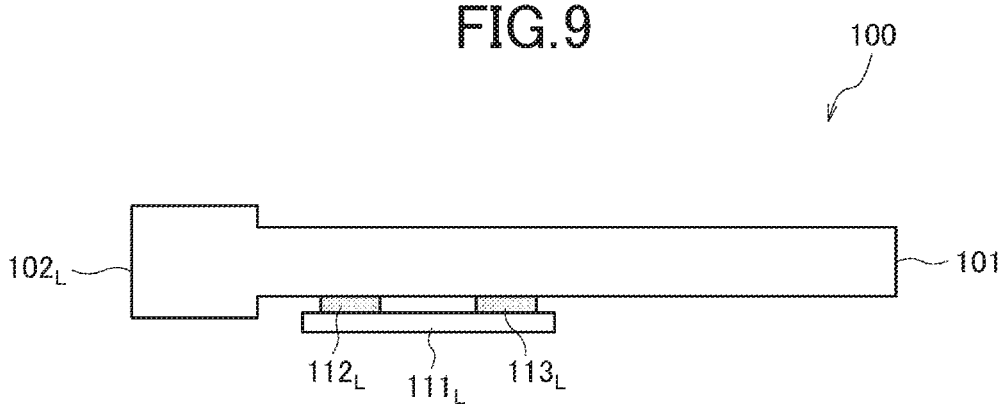
FIG. 9 is a front perspective view of a wearable speaker system according to Embodiment 5 of the present invention.

FIG. 9 is a left side view of a wearable speaker system 100 according to Embodiment 5 of the present invention. A difference from the previous embodiments is that a chest cushioning member $\mathbf{111}_L$ is provided on a lower surface of a first end region of an enclosure 101 via cushioning materials $112_L$ and $113_L$. Although a right side view of the wearable speaker system 100 is not illustrated in FIG. 9, a right side surface of the wearable speaker system 100 can have the same structure as that viewed from a left side surface. The chest cushioning member may be referred to as a second cushioning member.

When the wearable speaker system 100 is in a state of being hung on the neck as illustrated in FIG. 3, the cushioning materials $112_L$ and $113_L$ reduce the vibration of the enclosure 101 generated by the vibration of a diaphragm 103*c* of each of speakers $103_L$, and $103_R$, and prevents the vibration of the enclosure 101 from being directly transmitted to a portion of the upper chest of the listener. When medium and high sounds are emitted from the speakers $103_L$ and $103_R$, the listener may feel uncomfortable when the vibration due to the medium and high sounds is transmitted to the upper chest of the listener via the enclosure 101. Therefore, by transmitting the medium and high sounds to the listener via the chest cushioning member $111_L$, the bass can be mainly transmitted to the listener via the chest cushioning member $111_L$, thereby removing the discomfort feeling of the listener. As a material of the cushioning material, for example, an expandable and contractible material such as rubber, polyurethane foam, or a spring can be used.

REFERENCE SIGNS LIST

100 wearable speaker system
101 enclosure
$102_L$, $102_R$ speaker unit
$103_L$, $103_R$ speaker
$104_L$ first opening portion
$104_R$ second opening portion
103*a* speaker frame
103*b* magnetic circuit (permanent magnet and voice coil)
103*c* diaphragm
105*a* passive radiator frame
105*c* diaphragm
$106_L$ bass reflex duct

The invention claimed is:

1. A wearable speaker system comprising:

a U-shaped enclosure, wherein a first speaker unit and an opening portion at an end of a first bass reflex duet are disposed in a first end region of the enclosure, the first bass reflex duct being disposed inside the enclosure and having an internal space connected to an outside of the enclosure via the opening portion at the end of the first bass reflex duct, wherein a second speaker unit and an opening portion at an end of a second bass reflex duet are disposed in a second end region of the enclosure, the second bass reflex duct being disposed inside the enclosure and having an internal space connected to an outside of the enclosure via the opening portion at the end of the second bass reflex duct, wherein each of the first and second speaker units includes a speaker and a passive radiator that faces in an opposite direction from the speaker, and wherein a space between the speaker and the passive radiator included in each of the first and second speaker units is connected to a space in the enclosure.

2. The wearable speaker system according to claim 1, wherein main body portions of the first and second bass reflex ducts intersect each other at a center portion of the enclosure.

3. The wearable speaker system according to claim 1, wherein the first end region and die second end region of the enclosure communicate with each other.

4. The wearable speaker system according to claim 1, wherein the enclosure includes a partition that separates the first end region and the second end region of the enclosure into a plurality of spaces.

5. The wearable speaker system according to claim 1, wherein when the enclosure is hung on a neck of a listener, each of the opening portion at the end of the first bass reflex duct and the opening portion at the end of the second bass reflex duct is positioned below an ear of the listener.

6. The wearable speaker system according to claim 5, further comprising:

a cushioning member between the first end region and the second end region of the enclosure, and the listener.

7. The wearable speaker system according to claim 1, wherein when the enclosure is hung on a neck of a listener, each of the first and second speaker units is positioned on an upper chest of the listener.

8. The wearable speaker system according to claim 1, further comprising:

a cushioning member inside the U-shaped enclosure.

9. The wearable speaker system according to claim 1, wherein an opening portion at another end of the first bass reflex duct is disposed in an internal space of the enclosure, the first bass reflex duct extending in the internal space of the enclosure toward the second end region from the opening portion at the end of the first bass reflex duct to the opening portion at the other end of the first bass reflex duct, the internal space of the first bass reflex duct being connected to the internal space of the enclosure via the opening portion at the other end of the first bass reflex duct, and an opening portion at another end of the second bass reflex duct is disposed in the internal space of the enclosure, the second bass reflex duct extending in the internal space of the enclosure toward the first end region from the opening portion at the end of the second bass reflex duct to the opening portion at the other end of the second bass reflex duct, the internal space of the second bass reflex duct being connected to the internal space of the enclosure via the opening portion at the other end of the second bass reflex duct.

10. The wearable speaker system according to claim 1, wherein in each of the first and second speaker units, the passive radiator is disposed on a back surface of the speaker.

11. The wearable speaker system according to claim 1, wherein when the enclosure is hung on a neck of a listener, each of the opening portion at the end of the first bass reflex duct and the opening portion at the end of the second bass reflex duct is open upward facing the listener, and the speakers face upward.

12. The wearable speaker system according to claim 1, wherein the enclosure includes a first partition disposed near the first end region in an internal space of the enclosure and a second partition disposed near the second end region in the internal space of the enclosure.

* * * * *